US007340199B2

(12) United States Patent
Ito et al.

(10) Patent No.: US 7,340,199 B2
(45) Date of Patent: Mar. 4, 2008

(54) IMAGE FORMING DEVICE

(75) Inventors: Isao Ito, Saitama (JP); Iwao Kuriki, Saitama (JP); Hiroki Shiba, Saitama (JP); Katsumi Harumoto, Saitama (JP); Kazuhiro Saito, Saitama (JP); Akio Nishimura, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 3 days.

(21) Appl. No.: 10/889,135

(22) Filed: Jul. 13, 2004

(65) Prior Publication Data

US 2005/0013629 A1 Jan. 20, 2005

(30) Foreign Application Priority Data

Jul. 14, 2003 (JP) ..... 2003-274330

(51) Int. Cl.
*G03G 15/02* (2006.01)
*G03G 15/08* (2006.01)
*G03G 15/01* (2006.01)

(52) U.S. Cl. ..... 399/116; 399/121; 399/302

(58) Field of Classification Search ..... 399/116, 399/302, 107, 110, 121, 117
See application file for complete search history.

(56) References Cited

U.S. PATENT DOCUMENTS 6,571,073 B1 * 5/2003 Suzuki et al. ..... 399/116
6,738,590 B2 * 5/2004 Okimura et al. ..... 399/111
6,816,697 B2 * 11/2004 Suto et al. ..... 399/297
7,227,562 B2 * 6/2007 Asuwa et al. ..... 347/138
2002/0031369 A1 * 3/2002 Tokutake et al. ..... 399/110
2003/0099484 A1 * 5/2003 Tanaka et al. ..... 399/113
2005/0002688 A1 * 1/2005 Jeong et al. ..... 399/110

FOREIGN PATENT DOCUMENTS

JP A-62-178988 8/1987
JP 4093861 A2 * 3/1992
JP A-4-93861 3/1992
JP B-3033502 2/2000
JP A-2002-122188 4/2002

* cited by examiner

*Primary Examiner*—David M. Gray
*Assistant Examiner*—Joseph S. Wong
(74) *Attorney, Agent, or Firm*—Morgan, Lewis & Bockius LLP

(57) ABSTRACT

The present invention provides an image forming device, which facilitates maintenance and replacement of an intermediate transfer body and an image carrier, and prevents a deterioration in image quality which accompanies the formation of the intermediate transfer body and the image carrier as separate structures, having an image carrier on which a toner image is formed, and an intermediate transfer body conveying the toner image, which is formed on the image carrier, to a transfer medium, the image forming device including a supporting frame in which the intermediate transfer body is mounted, a suspension portion suspending the image carrier at the supporting frame to face the image carrier to the intermediate transfer body, and an attaching/removing portion at which the supporting frame is installed, and which is for attaching and removing the supporting frame to and from a device main body of the image forming device.

19 Claims, 11 Drawing Sheets

IMAGE FORMING DEVICE

CROSS-REFERENCE TO RELATED APPLICATION

This application claims priority under 35 USC 119 from Japanese Patent Application No. 2003-274330 the disclosures of which are incorporated by reference herein.

BACKGROUND OF THE INVENTION

1. Field of the Invention

The present invention relates to an image forming device in which a toner image formed on an image carrier is transferred onto a transfer medium by an intermediate transfer body.

2. Description of the Related Art

Various digital full-color laser printers (image forming devices) of so-called tandem type have conventionally been proposed. (See, for example, Japanese Patent No. 3033502 and Japanese Patent Application Laid-Open (JP-A) No. 62-178988.) Japanese Patent No. 3033502 discloses an image forming device in which an intermediate transfer body and a photosensitive body, which serves as an image carrier, are structured as separate units. In this image forming device, the intermediate transfer body and the photosensitive body can be replaced independently of one another. Therefore, the waste of the intermediate transfer body or the photosensitive body being replaced even though the life cycle thereof has not been completed can be eliminated.

However, Japanese Patent No. 3033502 does not disclose a structure for connecting an intermediate transfer body unit, which has the intermediate transfer body, and a photosensitive body unit, which has the photosensitive body, nor a structure for installing these in a device main body, or the like.

Moreover, JP-A Nos. 62-178988 and 4-93861 disclose preventing color offset by adjusting the phases of the gears of the intermediate transfer body and the photosensitive body. However, it is extremely difficult to adjust the phases of the gear of the intermediate transfer body and the gear of the photosensitive body which are structured as separate units.

SUMMARY OF THE INVENTION

The present invention has been developed in consideration of the above-described circumstances, and provides an image forming device which facilitates maintenance and replacement of an intermediate transfer body unit and an image carrier unit, and prevents a deterioration in image quality which accompanies the formation of the intermediate transfer body unit and the image carrier unit as separate structures.

An image forming device of an aspect of the present invention having an image carrier on which a toner image is formed, and an intermediate transfer body conveying the toner image, which is formed on the image carrier, to a transfer medium, includes: a supporting frame in which the intermediate transfer body is mounted; a suspension portion suspending the image carrier at the supporting frame to face the image carrier to the intermediate transfer body; and an attaching/removing portion at which the supporting frame is installed, and which is for attaching and removing the supporting frame to and from a device main body of the image forming device.

In the image forming device, a toner image is formed on the image carrier, and is conveyed to the transfer medium by the intermediate transfer body. The intermediate transfer body is installed in the supporting frame. The supporting frame is installed at the attaching/removing portion, and is inserted in and removed from the device main body by the attaching/removing portion. Therefore, attachment to and removal from the device main body are easy.

Further, the image carrier is suspended at the supporting frame by the suspension portion. Namely, the image carrier merely hangs down from the supporting frame and is not fixed thereto. Therefore, the image carrier can be easily taken off of the supporting frame.

Accordingly, maintenance and replacement of the intermediate transfer body and the image carrier are easy, and replacement by the user is possible. Further, the image carrier and the intermediate transfer body can be replaced separately from one another. Therefore, the waste of replacing an image carrier or an intermediate transfer body whose life cycle has not been completed can be eliminated.

The aspect of the present invention can be the image forming device having image carriers on which a toner image is formed, and intermediate transfer bodies conveying the toner image, which is formed on the image carrier, to a transfer medium, the image forming device including: an intermediate transfer body unit structured by a supporting frame in which the intermediate transfer bodies are mounted; an image carrier unit structured by the image carriers; a suspension portion suspending the image carrier at the supporting frame to mount the image carrier unit on the intermediate transfer body unit; and an attaching/removing portion at which the intermediate transfer body unit on which the image carrier unit is mounted is installed, and which is for attaching and removing the intermediate transfer body unit to and from a device main body of the image forming device.

Because the present invention has the above-described structure, maintenance and replacement of the intermediate transfer body unit and the image carrier unit are facilitated, and a deterioration in image quality which accompanies the forming of the intermediate transfer body unit and the image carrier unit as separate structures can be prevented.

BRIEF DESCRIPTION OF THE DRAWINGS

An example of an embodiment of the invention will be described in detail below with reference to the following drawings, wherein.

DETAILED DESCRIPTION OF THE INVENTION

Hereinafter, an embodiment of the present invention will be described with reference to the drawings.

Figure 1:
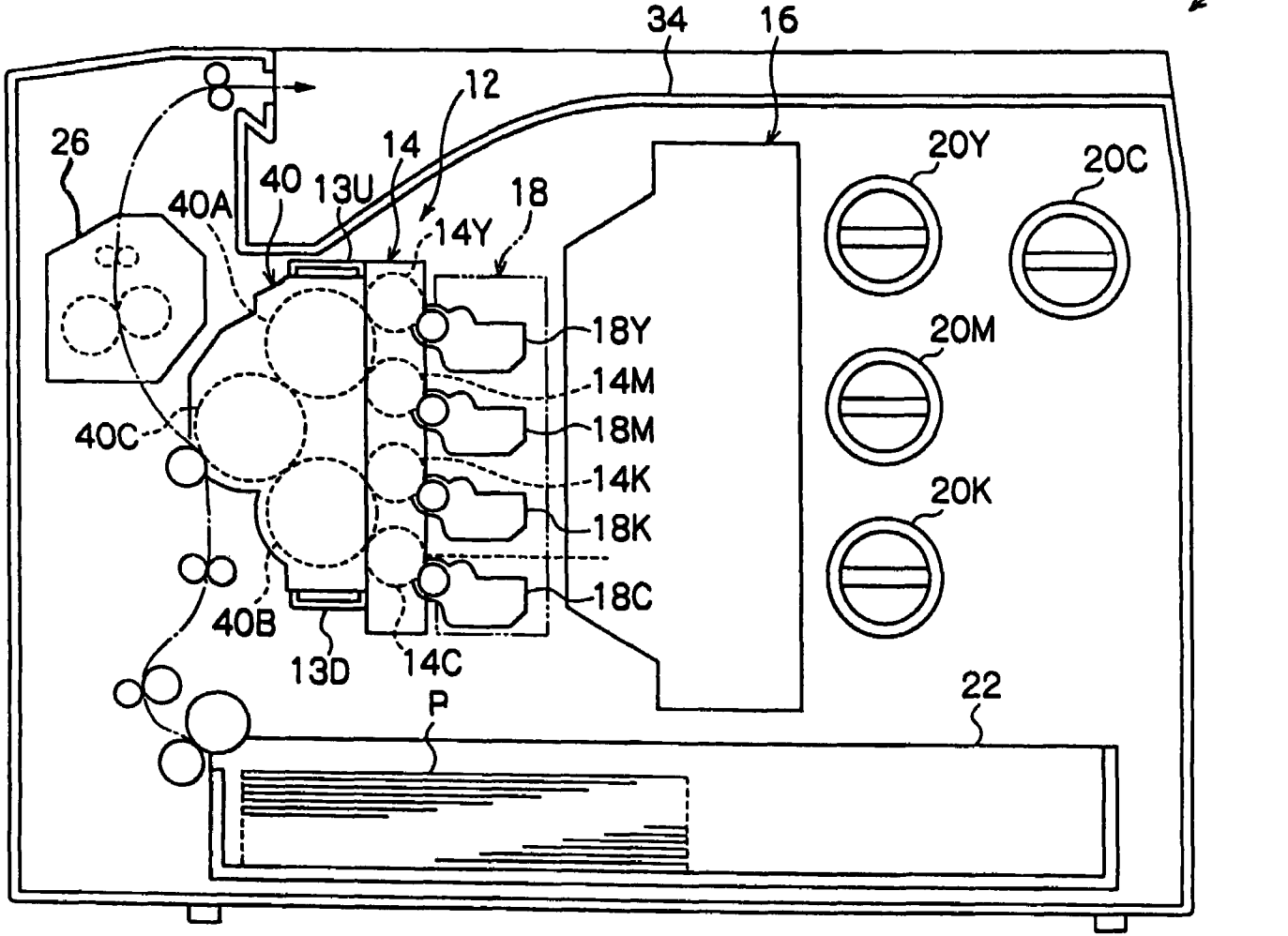
FIG. 1 is a schematic diagram showing the overall structure of a printer of an embodiment of the present invention.

As shown in FIG. 1, a print head device 12 is provided at a color laser printer (hereinafter called "printer") 10 serving as an image forming device. The print head device 12 forms a full-color image onto regular paper, recycled paper, an OHP sheet, or the like (hereinafter called "sheet P") which serves as a transfer medium.

Four photosensitive body drums 14Y, 14M, 14K, 14C are provided at the print head device 12. A light scanning device 16 is provided at the printer 10. The light scanning device 16 forms latent images on the four photosensitive body drums 14(Y,M,K,C) by scanning four light beams corresponding to the respective colors of yellow (Y), magenta (M), black (K), cyan (C), on the basis of image data of the respective colors of Y, M, K, C.

Four developing devices 18Y, 18M, 18K, 18C, which separately develop the latent images formed on the four photosensitive body drums 14(Y,M,K,C), are provided at the print head device 12. Four toner boxes 20Y, 20M, 20K, 20C, which separately supply Y, M, K, C toner to the developing devices 18(Y,M,K,C), are provided at the printer 10.

A sheet supplying cassette 22, which accommodates sheets P to be conveyed to the transfer section of the print head device 12, and a manual sheet feed tray (not shown in the drawings), for supplying sheets P from the exterior to the transfer section of the print head device 12, are provided at the printer 10.

Also provided at the printer 10 are a fixing device 26 which carries out fixing processing on the sheet P onto which the toner images have been transferred by the print head device 12, and a discharge tray 34 on which are stacked the sheets P on which images have been formed and which have been discharged.

Figure 2:
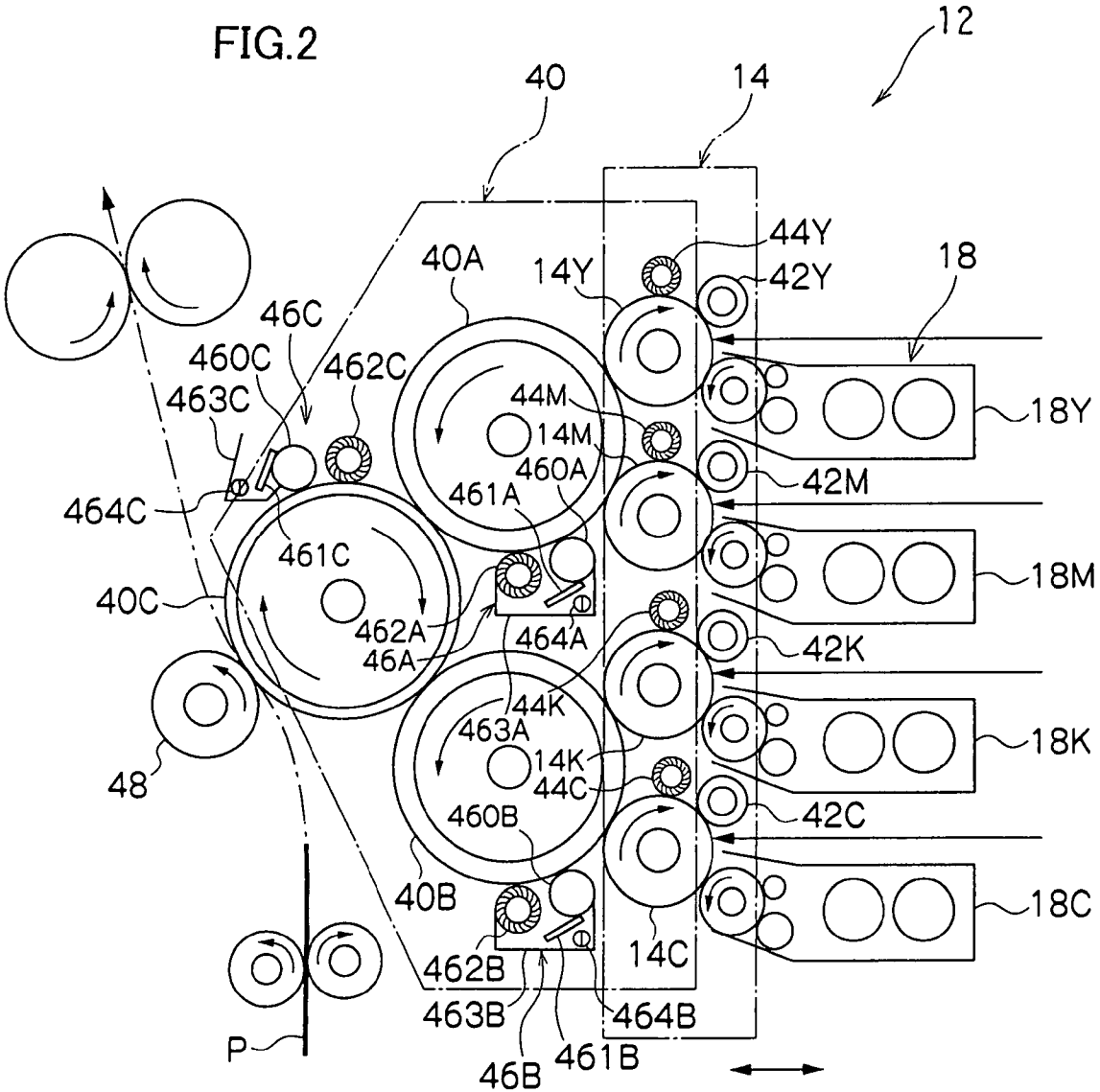
FIG. 2 is a schematic diagram showing a print head device of the printer of the embodiment.

As shown in FIG. 2, the print head device 12 is structured by a photosensitive body unit 14, a developing section 18 and an intermediate transfer body unit 40. The developing section 18 has the four developing devices 18(Y,M,K,C). The photosensitive body unit 14 has the four photosensitive body drums 14(Y,M,K,C). The intermediate transfer body unit 40 is provided as a unit which is separate from the photosensitive body unit 14, and conveys the toner images formed on the respective photosensitive bodies to the sheet P.

The photosensitive body drums 14(Y,M,K,C) are structured such that tubular drum main bodies, which have the same outer diameters and on which photosensitive layers formed from an organic photosensitive material or the like are formed, are supported at rotating shafts 15Y, 15M, 15K, 15C.

Provided at the intermediate transfer body unit 40 are: a first primary intermediate transfer drum 40A which contacts the photosensitive body drums 14(Y,M) such that the toner images of the two colors of Y, M are transferred thereto in a superposed manner; a second primary intermediate transfer drum 40B which contacts the photosensitive body drums 14(K,C) such that the toner images of the two colors of K, C are transferred thereto in a superposed manner; and a secondary intermediate transfer drum 40C which contacts the first primary intermediate transfer drum 40A and the second primary intermediate transfer drum 40B and a transfer roller 48, such that the toner images of the four colors of Y, M, K, C are transferred thereto in a superposed manner from the respective primary intermediate transfer body drums 40(A,B), and then transfers to the sheet P the toner image in which the four colors of Y, M, K, C are superposed.

The respective intermediate transfer drums 40(A,B,C) are structured such that drum main bodies are supported at rotating shafts 41A, 41B, 41C. The drum main bodies are formed by covering metal pipes, which are formed from iron or aluminum or the like and which have the same outer diameter, with a low-resistance elastic layer (resistance value: $10^2$ to $10^3$ Ω) having a thickness of about 0.1 to 10 mm and formed from electrically conductive silicon rubber or the like, and then forming on the surface of the low-resistance elastic layer a layer having high mold releasability (resistance value: about $10^5$ to $10^3$ Ω) having a thickness of 3 to 100 μm and formed from fluorine rubber or the like.

Charging rollers 42Y, 42M, 42K, 42C, which are for primary charging, and photosensitive body brush rollers 44Y, 44M, 44K, 44C, which recover and temporarily hold the untransferred, remaining toner which remains on the photosensitive body drums 14(Y,M,K,C) without having been transferred to the primary intermediate transfer drums 40(A,B), contact the photosensitive body drums 14(Y,M,K, C) respectively.

The charging rollers 42(Y,M,K,C) are formed by an electrically conductive, elastic, foamed body being coated to a given thickness on the periphery of a roller core formed from a metal (stainless steel), and are disposed further toward the upstream sides, in the directions of rotation of the photosensitive body drums 14(Y,M,K,C), than the scanning regions of the photosensitive body drums 14(Y,M,K,C).

The photosensitive body brush rollers 44(Y,M,K,C) are formed by plural brush bristles being embedded upright at a predetermined density distribution in a roller-shaped core formed from a metal (stainless steel), and are disposed at the upstream sides, in the directions of rotation of the photosensitive body drums, of the respective charging rollers.

A first cleaning device 46A which removes the untransferred, remaining toner on the first primary intermediate transfer drum 40A; a second cleaning device 46B which removes the untransferred, remaining toner on the second primary intermediate transfer drum 40B; and a third cleaning device 46C which removes the untransferred, remaining toner on the secondary intermediate transfer drum 40C, are provided in the intermediate transfer body unit 40.

The first cleaning device 46A has a cleaning roller 460A which is formed of a metal (stainless steel) and which contacts the first primary intermediate transfer drum 40A; a cleaning blade 461A which abuts the cleaning roller 460A; an intermediate transfer brush roller 462A which contacts the first intermediate transfer drum 40A at the upstream side, in the rotating direction of the first intermediate transfer drum 40A, of the cleaning roller 460A; a cleaner housing 463A in which these members are housed; and a screw auger 464A which conveys the untransferred, remaining toner, which has been scraped off in the cleaner housing 463A by the cleaning blade 461A, to an exterior toner recovery box (not illustrated). The intermediate transfer brush roller 462A has a structure which is similar to that of the photosensitive body brush rollers 44(Y,M,K,C).

In the same way as the first cleaning device 46A, the second cleaning device 46B has a cleaning roller 460B, a cleaning blade 461B, an intermediate transfer body brush roller 462B, a cleaning housing 463B, and a screw auger 464B.

In the same way as the first cleaning device 46A and the second cleaning device 46B, the third cleaning device 46C has a cleaning roller 460C, a cleaning blade 461C, an intermediate transfer body brush roller 462C, a cleaning housing 463C, and a screw auger 464C.

By a predetermined electric potential gradient being formed between the charging rollers 42(Y,M,K,C) and the photosensitive body drums 14(Y,M,K,C) and the intermediate transfer body drums 40(A,B,C) respectively, the untransferred, remaining toner, which is temporarily held at the photosensitive drum brush rollers 44(Y,M,K,C) and the intermediate transfer body brush rollers 462(A,B,C), is collected at the cleaning rollers 460(A,B,C) provided at the intermediate transfer body drums 40(A,B,C), and is scraped off into the cleaning housings 463(A,B,C) by the cleaning blades 461(A,B,C). The toner is then conveyed to the exterior toner recovery box by the screw augers 464(A,B,C).

In this way, the untransferred, remaining toner is recovered by each of the cleaning devices 46(A,B,C) provided in the intermediate transfer body unit 40, with providing only rollers for temporarily holding the untransferred, remaining toner in the photosensitive body unit 14. Therefore, it is possible to conserve the space, which would otherwise be occupied by cleaning devices within the photosensitive body unit 14, and the photosensitive body unit 14 can be made to be compact and light-weight. Accordingly, the maintenance and replacement of the photosensitive body unit 14 is easy.

Figure 3A:
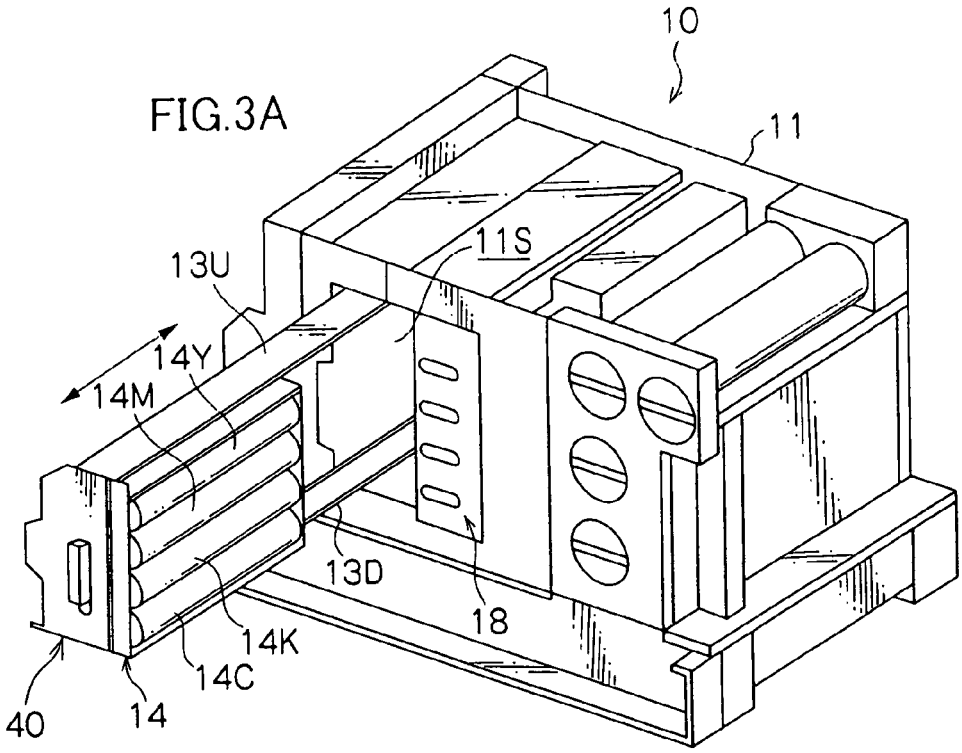
FIG. 3A is a perspective view showing the printer of the embodiment.
Figure 3B:
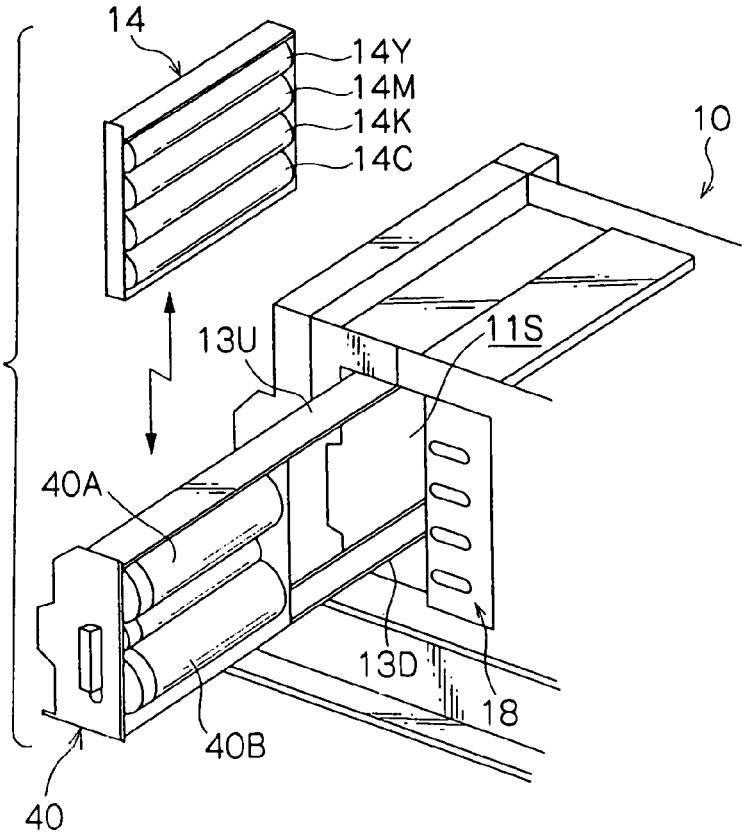
FIG. 3B is a perspective view showing the printer of the embodiment.

As shown in FIGS. 3A and 3B, the photosensitive body unit 14 and the intermediate transfer body unit 40 are structures which can be freely joined together and separated from one another, and are structured so as to be able to be freely installed in and removed from the device main body 11. Further, the photosensitive body unit 14 and the intermediate transfer body unit 40 which have been joined together are pushed-in and installed in an installation space 11S within the device main body 11 and are pulled-out and removed therefrom, along the axial directions of the respective photosensitive body drums 14(Y,M,K,C) and the respective intermediate transfer body drums 40(A,B,C). Note that the side in the direction in which the photosensitive body unit 14 and the intermediate transfer drum unit 40 are pushed-in is called the rear side of the printer, and the side in the direction in which they are pulled-out is called the front side of the printer.

Figure 4A:
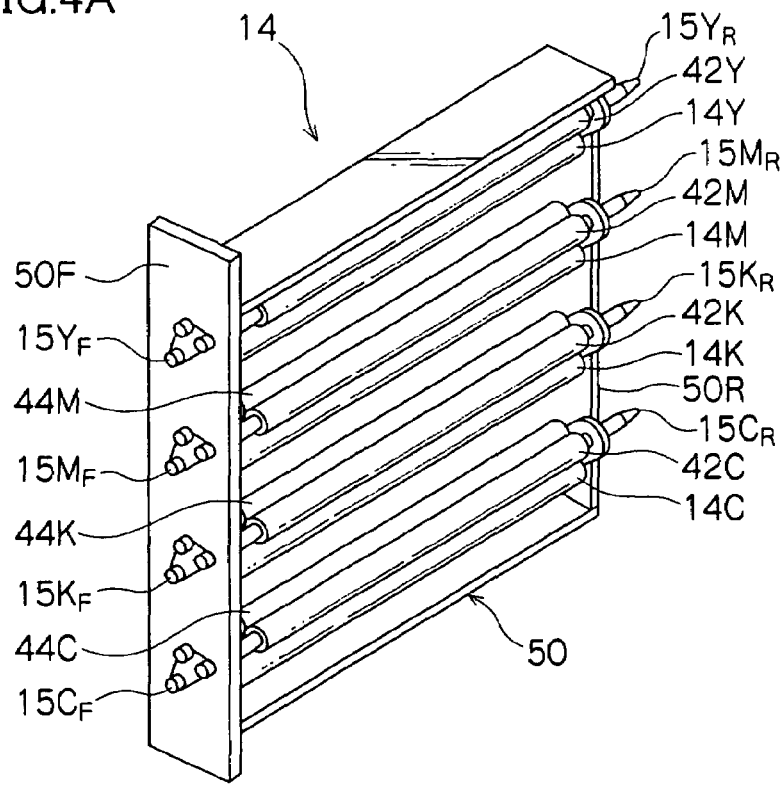
FIG. 4A is a perspective view showing a photosensitive body unit of the printer of the embodiment.
Figure 4B:
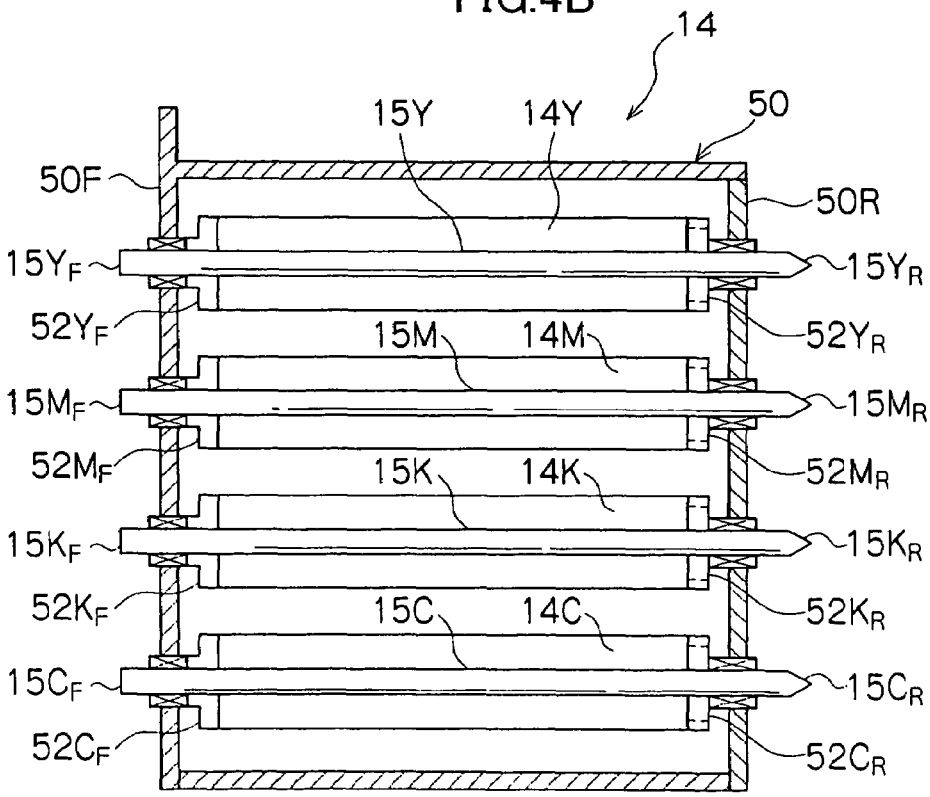
FIG. 4B is a sectional view of the photosensitive body unit of the printer of the embodiment.

As shown in FIGS. 4A and 4B, at the photosensitive body unit 14, the rotating shafts 15Y, 15M, 15K, 15C of the photosensitive body drums 14(Y,M,K,C) are mounted, via bearings and parallel to one another and separated from one another along the vertical direction at predetermined intervals, to a printer front-side side plate 50F and a printer rear-side side plate 50R of a supporting frame 50.

Axial direction end portions 15$Y_F$, 15$M_F$, 15$K_F$, 15$C_F$ at the printer front side and axial direction end portions 15$Y_R$, 15$M_R$, 15$K_R$, 15$C_R$ at the printer rear side, of the rotating shafts 15(Y,M,K,C) of the photosensitive drums 14(Y,M,K,C), project from the side plates 50F, 50R.

Figure 5:
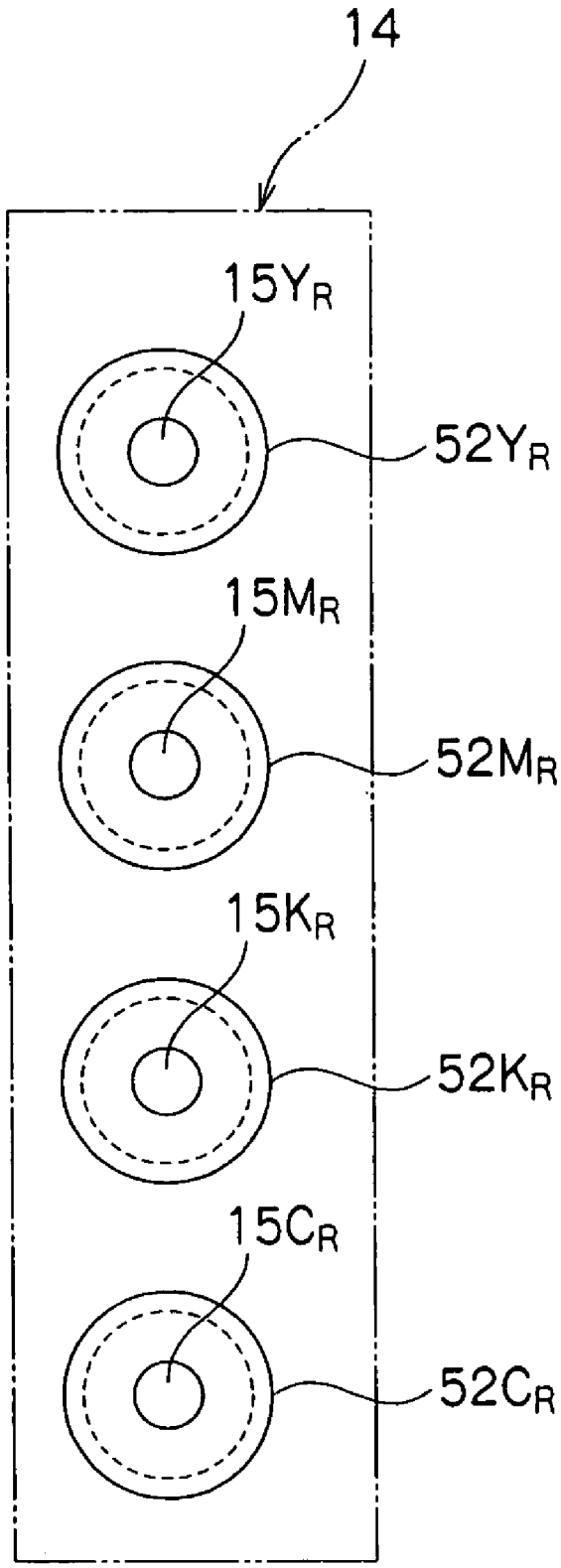
FIG. 5 is a schematic diagram showing the connection of gears of the photosensitive body unit of the printer of the embodiment.
Figure 6A:
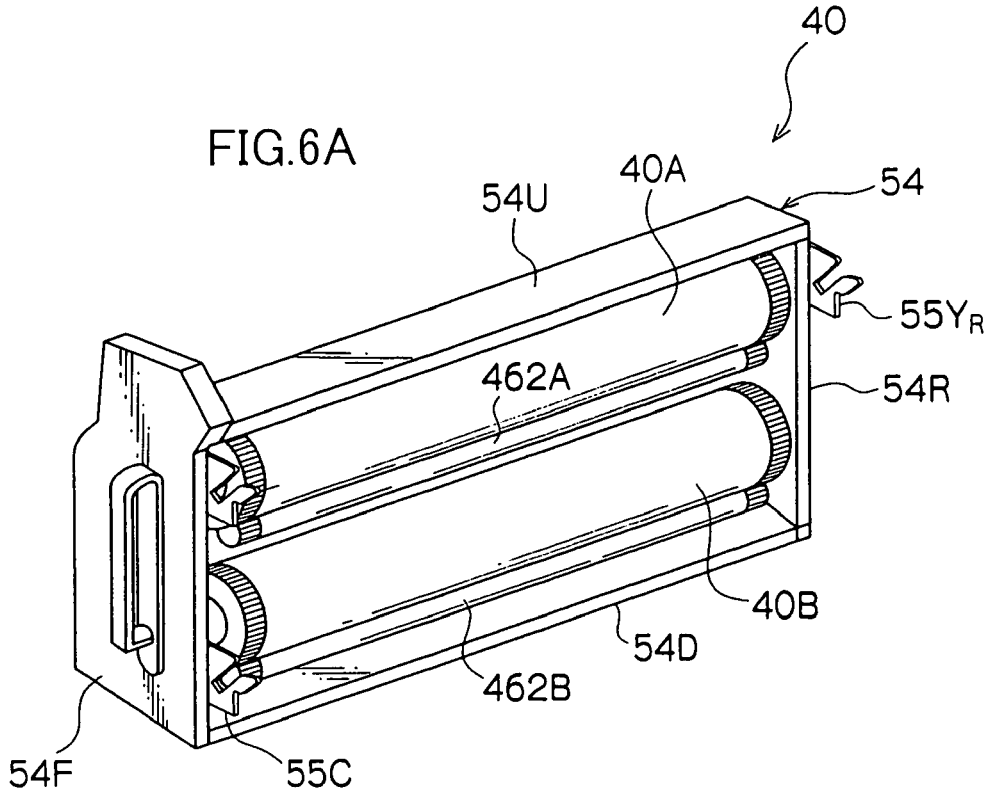
FIG. 6A is a perspective view showing an intermediate transfer body unit of the printer of the embodiment.
Figure 6B:
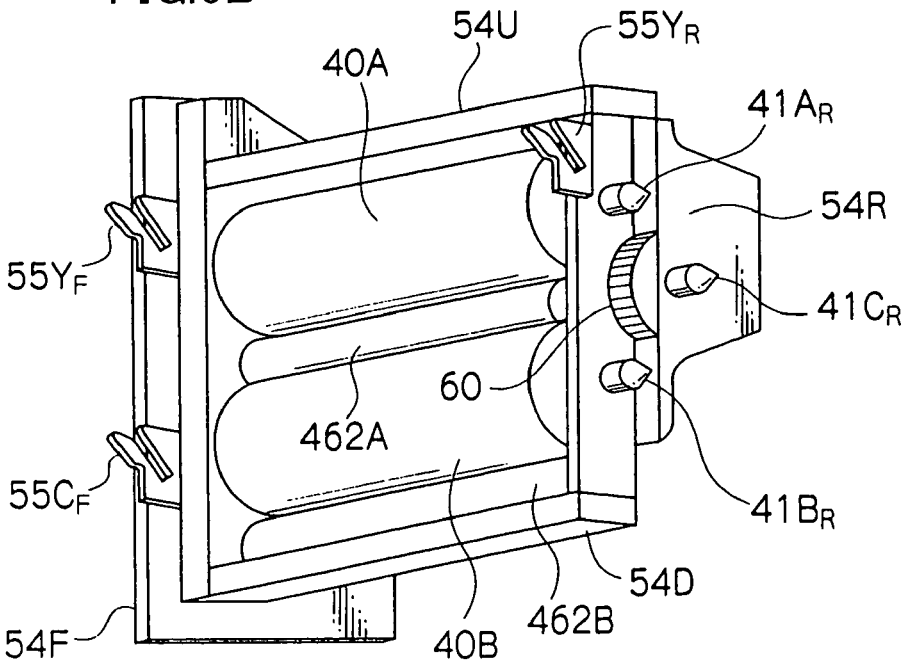
FIG. 6B is a perspective view showing the intermediate transfer body unit of the printer of the embodiment.

As shown in FIG. 4B and FIG. 5, photosensitive body rear side gears 52$Y_R$, 52$M_R$, 52$K_R$, 52$C_R$, which have the same configurations, are attached to the axial direction printer rear sides of the rotating shafts 15(Y,M,K,C) of the photosensitive drums 14(Y,M,K,C). The photosensitive body rear side gears 52($Y_R$,$M_R$,$K_R$,$C_R$) mesh with intermediate transfer body rear side gears 56$A_R$,56$B_R$ which will be described later, such that driving force is transmitted.

Photosensitive body front side gears 52$Y_F$, 52$M_F$, 52$K_F$, 52$C_F$, which have the same configurations, are attached to the axial direction printer front sides of the rotating shafts 15(Y,M,K,C) of the photosensitive drums 14(Y,M,K,C). The photosensitive body front side gears 52($Y_F$,$M_F$,$K_F$,$C_F$) mesh with gears (not illustrated) which are attached to the rotating shafts of the charging rollers 42(Y,M,K,C) and the photosensitive body brush rollers 44(Y,M,K,C), so as to transmit driving force. The photosensitive body front side gears 52($Y_F$,$M_F$,$K_F$,$C_F$) rotate the charging rollers 42(Y,M,K,C) and the photosensitive body brush rollers 44(Y,M,K,C) at the same speed, or substantially the same speed, as the photosensitive body drums 14(Y,M,K,C).

As shown in FIGS. 6A, 6B, 7A, 7B, at the intermediate transfer drum unit 40, the rotating shafts 41A, 41B, 41C of the intermediate transfer drums 40(A,B,C) are mounted, via bearings and parallel to one another and separated from one another along the vertical direction and a horizontal direction predetermined intervals, to a front-side side plate 54F and a rear-side side plate 54R of a supporting frame 54 which is assembled in the shape of a rectangular frame. End portions 41$A_R$, 41$B_R$, 41$C_R$ at the printer rear side in the axial direction of the rotating shafts 41(A,B,C) project out from the side plate 54R.

A ceiling plate 54U and a floor plate 54D of the supporting frame 54 are slide rails which are slidably loaded in slide rails 13U, 13D provided at the installation space 11S of the device main body 11, such that the intermediate transfer body unit 40 can be slid in and out of the installation space 11S.

A hook 55$Y_F$ on which the rotating shaft end 15$Y_F$ of the photosensitive body unit 14 is hung when the photosensitive body unit 14 is joined to the intermediate transfer body unit 40, and a hook 55$C_F$ on which the rotating shaft end 15$C_F$ is hung when the photosensitive body unit 14 is joined to the intermediate transfer body unit 40, are provided at the side plate 54F. A hook 55$Y_R$ on which the rotating shaft end 15$Y_R$ is hung when the photosensitive body unit 14 is joined to the intermediate transfer body unit 40, is provided at the side plate 54R.

Figure 7A:
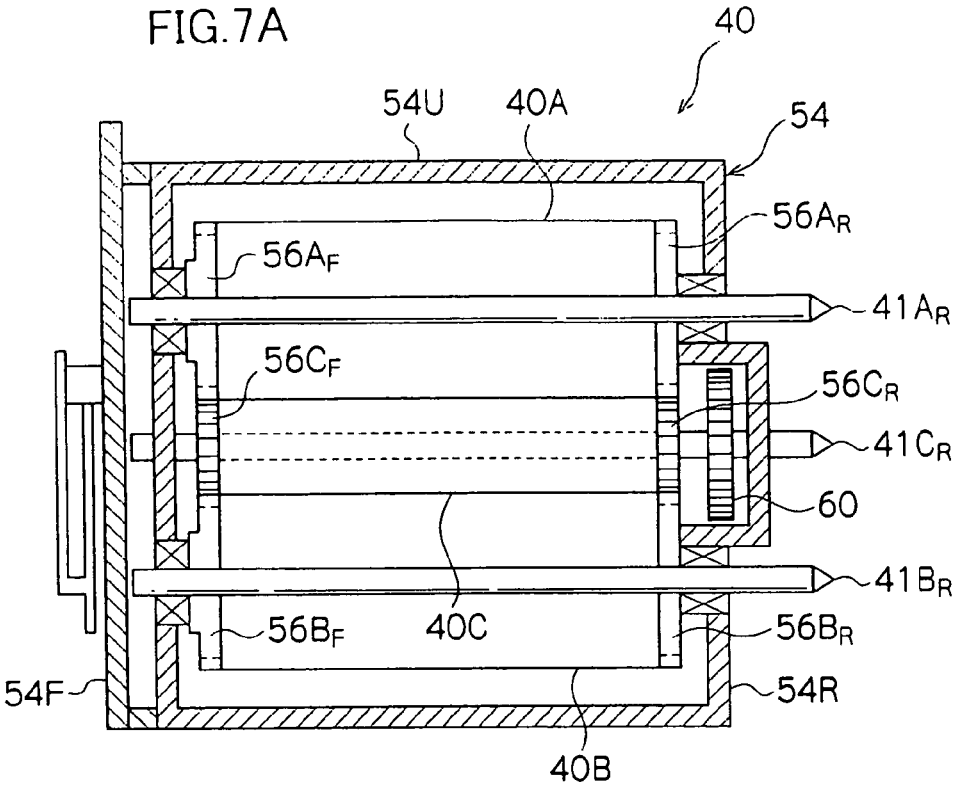
FIG. 7A is a sectional view showing the intermediate transfer body unit of the printer of the embodiment.
Figure 7B:
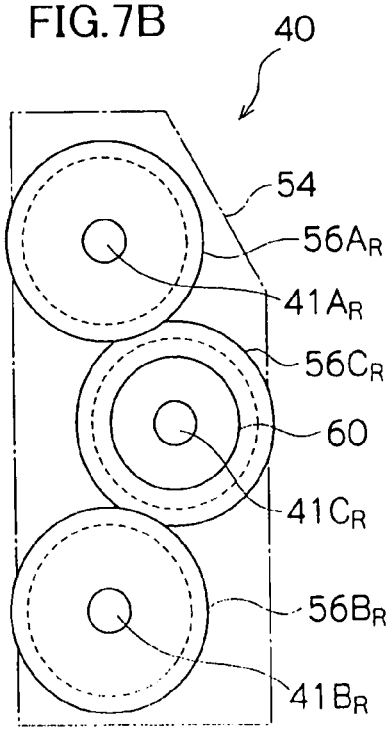
FIG. 7B is a schematic diagram showing the connection of gears of the intermediate transfer body unit of the printer of the embodiment.

Further, as shown in FIGS. 7A and 7B, the intermediate transfer body rear side gears 56$A_R$, 56$B_R$, 56$C_R$, which have the same configurations, are attached to the axial direction printer rear sides of the rotating shafts 41(A,B,C) of the intermediate transfer drums 40(A,B,C). When the photosensitive body unit 14 is joined to the intermediate transfer body unit 40, the intermediate transfer body rear side gears 56($A_R$,$B_R$,$C_R$) mesh with the photosensitive body rear side gears 52($Y_R$,$M_R$,$K_R$,$C_R$) and transmit driving force.

Intermediate transfer body front side gears 56$A_F$, 56$B_F$, 56$C_F$, which have the same configurations, are attached to the axial direction printer front sides of the rotating shafts 41(A,B,C) of the intermediate transfer drums 40(A,B,C). The intermediate transfer body front side gears 56($A_F$,$B_F$, $C_F$) mesh with and transmit driving force to gears (not illustrated) which are attached to the rotating shafts of the cleaning rollers 460(A,B,C) and the intermediate transfer body brush rollers 462(A,B,C). In this way, the cleaning rollers 460(A,B,C) and the intermediate transfer body brush rollers 462(A,B,C) are rotated at the same speed, or substantially the same speed, as the intermediate transfer body drums 40(A,B,C).

Figure 8:
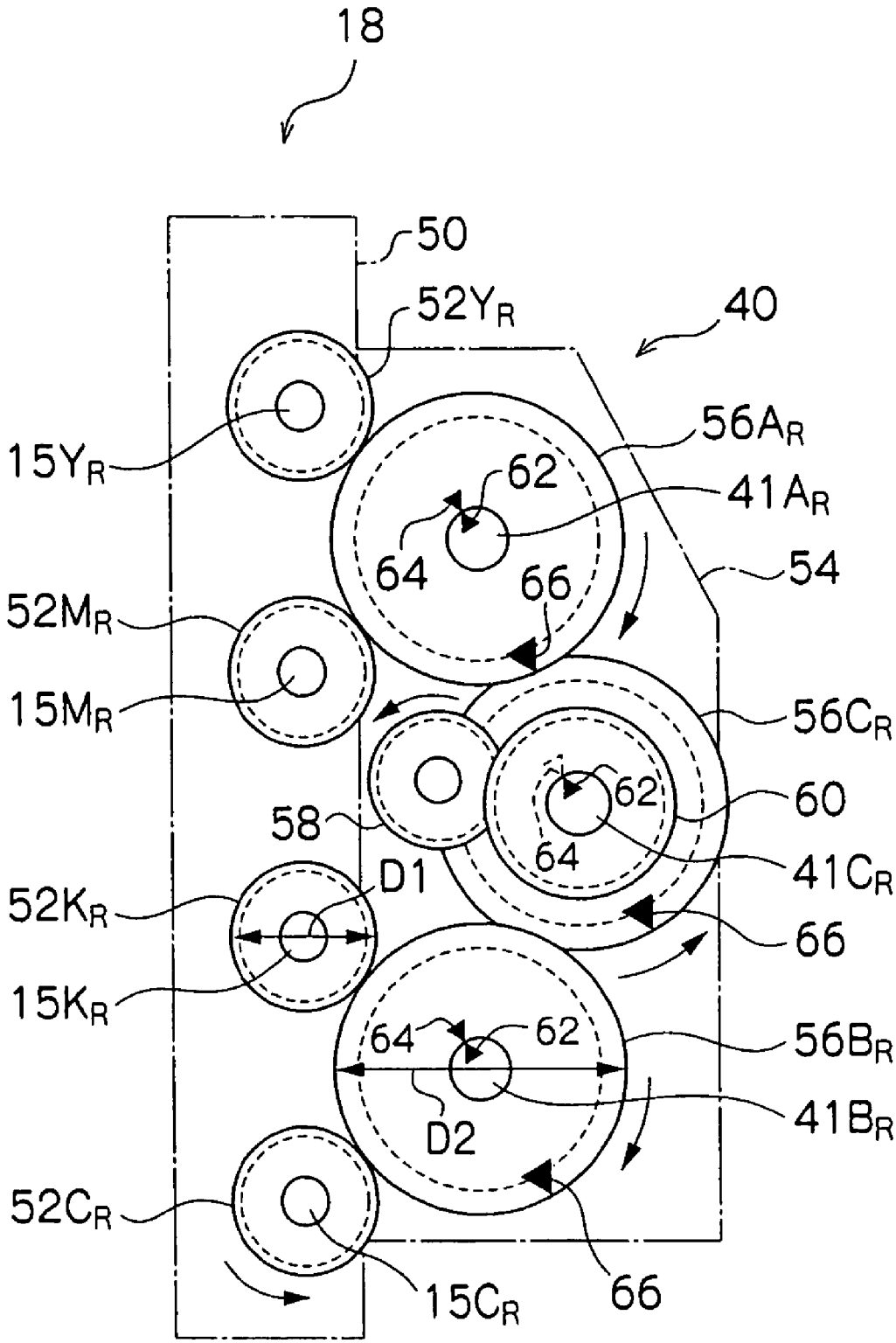
FIG. 8 is a schematic diagram showing the connection of gears of the photosensitive body unit and the intermediate transfer body unit of the printer of the embodiment.

Moreover, as shown in FIGS. 7A and 7B and in FIG. 8, a transmitted-to gear 60 is attached to the axial direction printer rear side of the rotating shaft 41C of the secondary intermediate transfer body drum 40C. When the intermediate transfer body unit 40 is installed in the device main body 11, the transmitted to gear 60 meshes with a driving gear 58 to which is transmitted the driving force of a driving motor (not illustrated) disposed in the installation space 11S of the device main body 11.

In this way, the photosensitive body unit 14 and the intermediate transfer body unit 40, which can be joined together and separated from one another, are driven by the same drive source which is disposed at the exterior of both units. Therefore, space for providing driving sources at the both units can be conserved, and the both units can be made to be compact and light-weight. Further, the degrees of freedom in design increase.

As compared with a structure in which a drive source is provided at each of the photosensitive body unit 14 and the intermediate transfer body unit 40 and the photosensitive body drums 14(Y,M,K,C) and the intermediate transfer body drums 40(A,B,C) are driven by individual drive sources, it is easy to synchronize the rotation of the photosensitive body drums 14(Y,M,K,C) and the rotation of the intermediate transfer body drums 40(A,B,C), and the occurrence of image offset at the time of transfer can be prevented.

Further, because the gears for transmitting driving are provided at the photosensitive body unit 14 and the intermediate transfer body unit 40, the gears are replaced at the time when the unit is replaced. Therefore, deterioration of the gears over time can be prevented.

As shown in FIG. 8, the relationship between a diameter D1 of the photosensitive body drums 14(Y,M,K,C) and a diameter D2 of the intermediate transfer body drums 40(A,B,C) is D1=½×D2. Namely, the diameter D2 of the intermediate transfer body drums 40(A,B,C) is twice (i.e., an integer multiple) the diameter D1 of the photosensitive body drums 14(Y,M,K,C). While the intermediate transfer body drums 40(A,B,C) are rotating one time, the photosensitive body drums 14(Y,M,K,C) inevitably rotates n times. While the intermediate transfer body drums 40(A,B,C) are rotating one time, the photosensitive body drums 14(Y,M,K,C) are n times at a maximum eccentricity with respect to the intermediate transfer body drums 40(A,B,C). However, the timing thereof is constant. Therefore, it suffices to adjust, in accordance with this timing, the phases which are based on the directions of eccentricity of the intermediate transfer body drums 40(A,B,C). There is no need to adjust the phases between the intermediate transfer body drums 40(A,B,C) and the photosensitive body drums 14(Y,M,K,C).

Thus, as the phase adjustment of the intermediate transfer body drums 40(A,B,C), the positions of attachment, in the rotational directions, of the intermediate transfer body rear side gears 56($A_R$,$B_R$,$C_R$) and the intermediate transfer body drums 40(A,B,C) are adjusted such that, at the time when the toner images are transferred from the primary intermediate transfer body drums 40(A,B) to the secondary intermediate transfer body drum 40C, the phases in the rotation direction which are based on the eccentric directions of the intermediate transfer body drums 40(A,B,C) become the same at all of the intermediate transfer body drums 40(A,B,C).

Specifically, first, triangular marks 62 are marked at the points where the phases in the rotation direction which are based on the eccentric directions of the intermediate transfer body drums 40(A,B,C) become maxima. Then, triangular marks 64 are marked at the points where the phases in the rotation direction which are based on the eccentric directions of the intermediate transfer body rear side gears 56($A_R$,$B_R$, $C_R$) attached to the rotating shafts 41(A,B,C) of the intermediate transfer body drums 40(A,B,C) become minima, and triangular marks 66 are marked at the points where they become maxima.

Then, the intermediate transfer body drums 40(A,B,C) and the intermediate transfer body rear side gears 56($A_R$, $B_R$,$C_R$) are assembled while the rotating direction positions of the triangular marks 62, 64 are made to coincide. Namely, assembly is carried out by matching the points where the eccentricities of the intermediate transfer body drums 40(A, B,C) become maxima and the points where the eccentricities of the intermediate transfer body rear side gears 56($A_R$,$B_R$, $C_R$) become minima.

Moreover, the points of the triangular marks 64 and the triangular marks 66, of the intermediate transfer body rear side gear 56$A_R$ and the intermediate transfer body rear side gear 56$B_R$, and the intermediate transfer body rear side gear 56$B_R$ and the intermediate transfer body rear side gear 56$C_R$, respectively, are made to mesh together, and the intermediate transfer body drums 40(A,B,C) are assembled together.

In this way, the eccentricities of the intermediate transfer body drums 40(A,B,C) and the intermediate transfer body rear side gears 56($A_R$,$B_R$,$C_R$) are cancelled. The phases in the rotating directions at the time of transfer from the primary intermediate transfer body drums 40(A,B) to the secondary intermediate transfer body drum 40C, and from the secondary intermediate transfer body drum 40C to the sheet P, coincide, and color offset can be prevented.

Next, the operations of joining together and installing the photosensitive body unit 14 and the intermediate transfer body unit 40 will be described.

Figure 9:
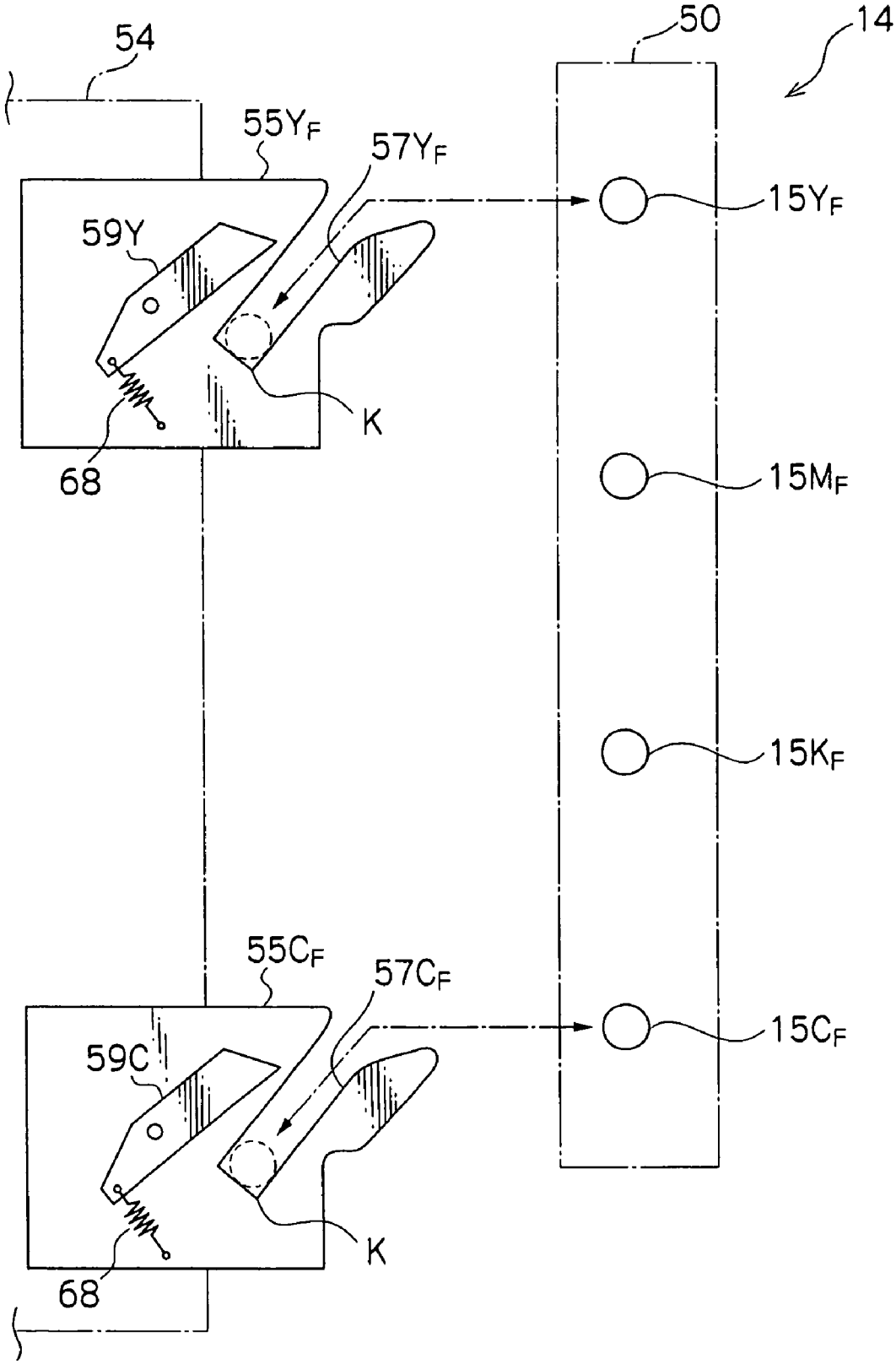
FIG. 9 is a schematic diagram showing a state in which the photosensitive body unit and the intermediate transfer body unit of the printer of the embodiment are separated from one another.

As shown in FIG. 9, the joining together of the photosensitive body unit 14 and the intermediate transfer body unit 40 is carried out by the both axial direction end portions 15$Y_F$, 15$Y_R$ of the rotating shaft 15Y of the photosensitive body drum 14Y being inserted into anchor grooves 57$Y_F$, 57$Y_R$ of the hooks 55$Y_F$, 55$Y_R$, and the axial direction front side end portion 15$C_F$ of the rotating shaft 15C of the photosensitive body drum 14C being inserted into an anchor groove 57$C_F$ of the hook 55$C_F$, such that the photosensitive body unit 14 is supported at the intermediate transfer body unit 40.

Figure 10:
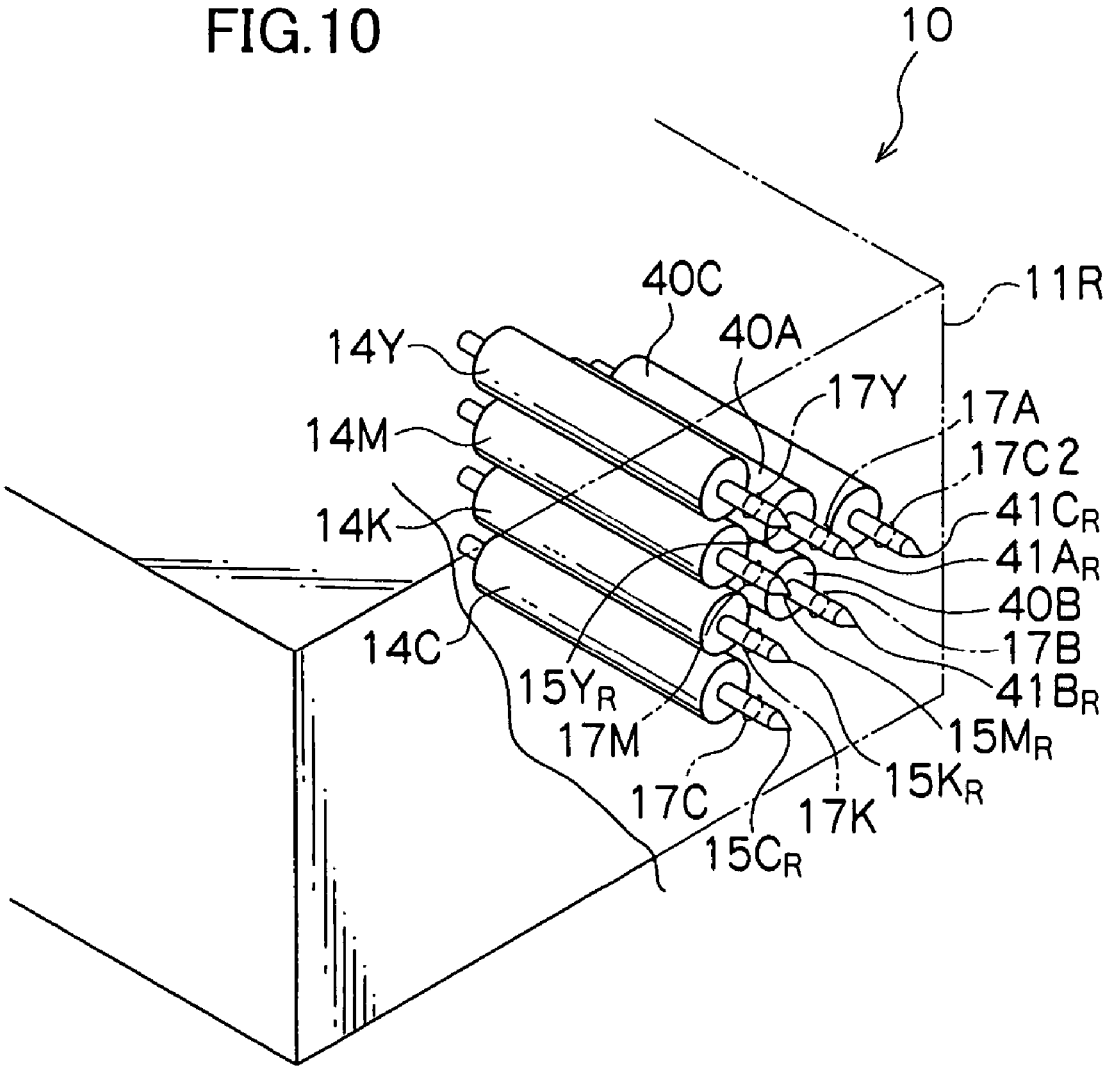
FIG. 10 is a perspective view showing a state in which the photosensitive body unit and the intermediate transfer body unit of the printer of the embodiment are installed in a device main body.

In this state, as shown in FIG. 10, when the joined-together photosensitive body unit 14 and intermediate transfer body unit 40 are pushed into the installation space 11S, the rotating shafts 15($Y_R$,$M_R$,$K_R$,$C_R$), which are projecting from the side plate 50R of the photosensitive body unit 14, fit-together with positioning holes 17Y, 17M, 17K, 17C formed in a printer rear side frame 11R of the device main body 11. Further, the rotating shafts 41($A_R$,$B_R$,$C_R$), which are projecting from the side plate 54R of the intermediate transfer body unit 40, are fit-together with positioning holes 17A, 17B, 17C formed in the frame 11R. In this way, the axial direction positioning, at the printer rear side, of the photosensitive drums 14(Y,M,K,C) and the intermediate transfer body drums 40(A,B,C) is carried out.

Figure 11:
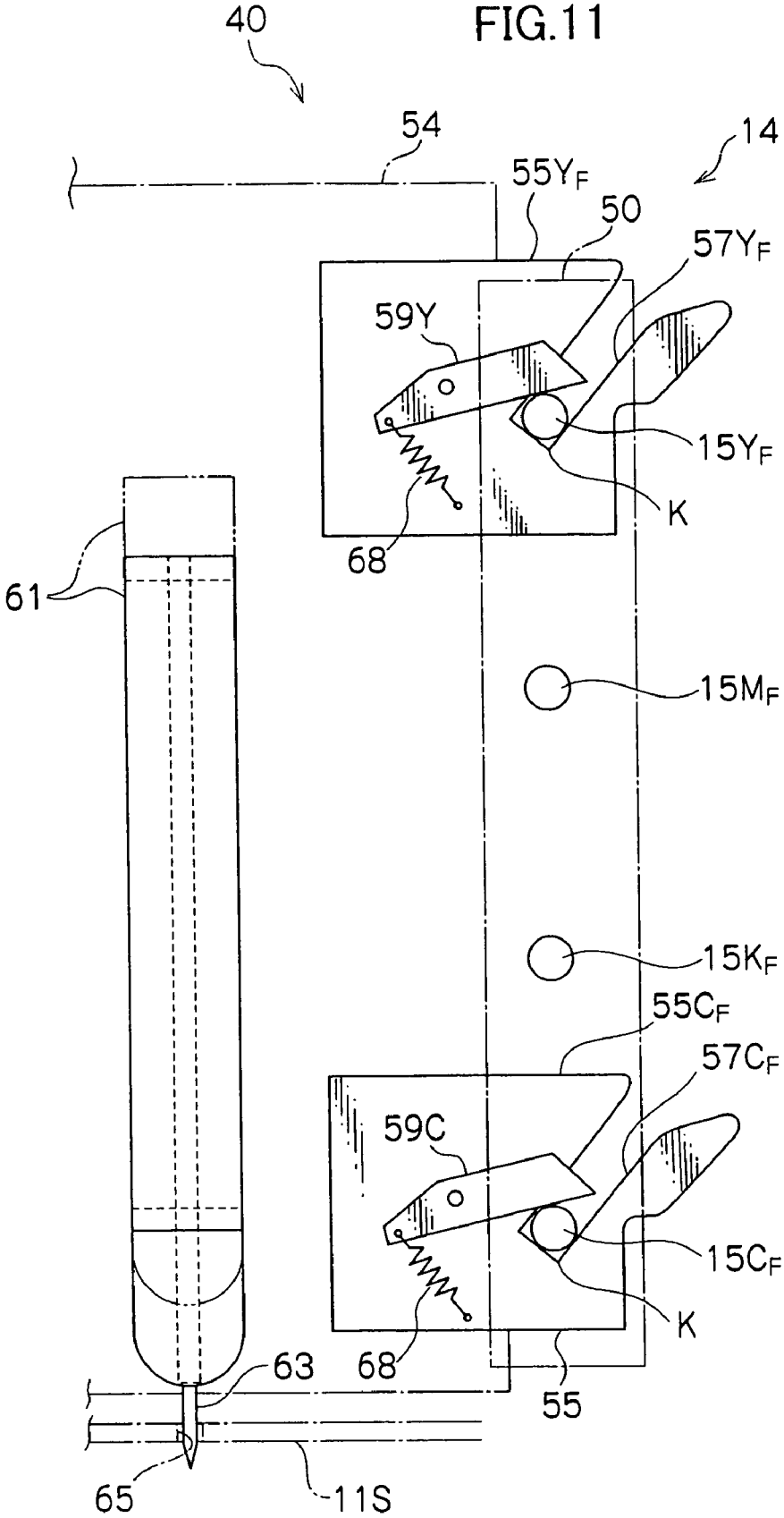
FIG. 11 is a schematic diagram showing a state in which the photosensitive body unit and the intermediate transfer body unit of the printer of the embodiment are joined together.

As shown in FIG. 11, stoppers 59Y, 59C, which fix and position the end portions 15($Y_F$,$C_F$) of the rotating shafts 15(Y,C) inserted in the anchor grooves 57$Y_F$, 57$C_F$, are provided at the printer front-side side plate 54F of the intermediate transfer body unit 40. These stoppers 59(Y,C) are rotatably supported at the hooks 55(Y,C), and are rotated clockwise by link mechanisms (not illustrated) so as to push the end portions 15($Y_F$,$C_F$) to abut the anchor grooves 57($Y_F$,$C_F$). Here, the end portions 15($Y_F$,$C_F$) are pushed to abut and point-contact corner portions K of the anchor grooves 57($Y_F$,$C_F$). Therefore, the positioning accuracy is high.

Longitudinal direction one end portions of the stoppers 59(Y,C) are pushed to abut the end portions 15($Y_F$,$C_F$). One end portions of helical extension springs 68 are attached to the longitudinal direction other end portions of the stoppers 59(Y,C). The other end portions of the helical extension springs 68 are attached to the hooks 55($Y_F$,$C_F$). Therefore, when the clockwise direction rotation caused by the link mechanisms is cancelled, as shown in FIG. 9, the stoppers 59(Y,C) are rotated counterclockwise by the helical extension springs 68 and move away from the anchor grooves 57($Y_F$,$C_F$). In this state, the photosensitive body unit 14 can be attached to and removed from the intermediate transfer body unit 40.

As shown in FIG. 11, a lever 61 is provided at the side plate 54F so as to be able to move up and down. A positioning pin 63 projects downward from the reverse side of this lever. A positioning hole 65, which this positioning pin 63 fits together with, is provided in the floor portion of the installation space 11S. In this way, the printer front side of the intermediate transfer body unit 40 is positioned, and the intermediate transfer body drums 40(A,B,C) and the photosensitive body drums 14(Y,M,K,C) are completely positioned in the device main body 11.

An image forming device of another aspect of the present invention has the feature that an image carrier unit, which is structured by the plural image carriers having: charging portions which are disposed at upstream sides, in rotating directions of the image carriers, of scanning regions of the image carriers, and which charge the image carriers; and recovering/holding portions which are disposed at upstream sides, in the rotating directions of the image carriers, of the charging portions, and which recover toner remaining on the image carriers and temporarily hold the toner.

In this aspect, the charging portions and the recovering/holding portions are provided at the image carrier body unit which is structured by plural image carriers. The charging portions are disposed at the upstream sides, in the rotating directions of the image carriers, of the scanning regions of the image carriers, and charge the image carriers. The recovering/holding portions are disposed at the upstream sides, in the rotating directions of the image carriers, of the charging portions, and recover the toner remaining at the image carriers and temporarily hold the toner.

Here, the untransferred, remaining toner which remains on the image carriers is temporarily held at the recovering/holding portions, and there is no need for a portion which discharges the untransferred, remaining toner to the exterior of the image carrier unit. The image carrier unit can be kept to the minimal structure of the image carriers, the charging portions, and the recovering/holding portions. Accordingly, the image carrier unit can be made to be compact, and handling thereof is easy, and costs for transporting the image carrier unit can be reduced.

An image forming device of another aspect of the present invention has the feature that the plural intermediate transfer bodies are mounted at the supporting frame to form an intermediate transfer body unit, and the intermediate transfer body unit having: removing portions removing toner remaining on the intermediate transfer bodies; and conveying portions conveying the toner, which has been removed from the intermediate transfer bodies by the removing portions, to an exterior of the intermediate transfer body unit.

In the image forming device of this aspect, plural intermediate transfer bodies are installed at the supporting frame so as to form an intermediate transfer body unit. Removing portions and conveying portions are provided at the intermediate transfer body unit. The removing portions remove the toner remaining on the intermediate transfer bodies. The conveying portions convey, to the exterior of the intermediate transfer body unit, the untransferred, remaining toner which has been removed from the intermediate transfer bodies by the removing portions.

Here, if a structure is used in which the untransferred, remaining toner, which is temporarily held at the recovering/holding portions of the image carrier unit, is transferred to the intermediate transfer bodies, and is removed from the intermediate transfer bodies by the removing portions, and is conveyed to the exterior by the conveying portions, there is no need to provide at the image carrier unit a conveying mechanism for conveying the toner to the exterior. Accordingly, the image carrier unit can be made to be compact and light-weight.

An image forming device of another aspect of the present invention has the feature that the image carrier unit has four image carriers at which are formed single-color toner images of yellow, magenta, cyan, and black, respectively.

In the image forming device of this aspect, four image carriers, at which single-color toner images of yellow, magenta, cyan, and black are formed respectively, are provided at the image carrier unit. A full-color image forming device is provided in which replacement and maintenance of the image carrier unit and the intermediate transfer body unit are easy.

An image forming device of another aspect of the present invention has the feature that an image carrier unit, which is structured by the plural image carriers, has image carrier gears disposed at axial direction one end portions of the image carriers, and an intermediate transfer body unit, which is structured by the supporting frame at which the plural intermediate transfer bodies are mounted, has intermediate transfer body gears disposed at axial direction one end portions of the intermediate transfer bodies which contact the image carriers having the image carrier gears at the axial direction one end portions thereof, the intermediate transfer body gears meshing with the image carrier gears and transmitting driving force to the image carriers.

In the image forming device of this aspect, the image carrier gears, which are disposed at one axial direction end portions of the image carriers, and the intermediate body transfer gears, which are disposed at one axial direction end portions of the intermediate transfer bodies, mesh together. The image carriers are driven by the driving force transmitted from the intermediate transfer body gears.

In this way, as compared with a structure in which drive sources are provided at the image carrier unit and the intermediate transfer body unit respectively and the image carriers and the intermediate transfer bodies are driven by the individual drive sources, it is easy to synchronize the rotation of the image carriers and the rotation of the intermediate transfer bodies, and the occurrence of image offset at the time of transfer can be prevented.

Further, at least the space required for the placement of a drive source of the image carrier unit can be conserved. Therefore, the image carrier unit can be made to be compact and light-weight.

An image forming device of another aspect of the present invention has the feature that a relationship between a diameter D1 of the image carriers and a diameter D2 of the intermediate transfer bodies is D1=D2×1/n, where n is a natural number of 2 or more, and at the intermediate transfer body unit, mounted positions, in a rotating direction, of the intermediate transfer body gears and the intermediate transfer bodies are adjusted such that phases, in the rotating direction, are substantially the same at all of the intermediate transfer bodies at a time when the toner image is transferred from an upstream intermediate transfer body which is disposed at upstream side in conveying direction of the toner image, to a downstream intermediate transfer body which is disposed at downstream side in the conveying direction of the toner image.

In the image forming device of this aspect, the relationship between the diameter D1 of the image carrier and the diameter D2 of the intermediate transfer body is D1=D2×1/n (where n is a natural number of 2 or more). When the intermediate transfer body rotates one time, the image carrier inevitably rotates n times. While the intermediate transfer body is rotating one time, the image carrier is a maximum eccentricity with respect to the intermediate transfer body n times. However, the timing thereof is constant. Therefore, it suffices to adjust, in accordance with this timing, the phase in the rotating direction of the intermediate transfer body. There is no need to adjust the phases between the intermediate transfer body and the image carrier.

Here, as the way of adjusting the phases of the intermediate transfer bodies, the mounted positions, in the rotating direction, of the intermediate transfer body gears and the intermediate transfer bodies are adjusted such that the phases, in the rotating direction, are substantially the same at all of the intermediate transfer bodies at the time when the toner image is transferred from upstream intermediate transfer body which is disposed at upstream side in conveying direction of the toner image, to downstream intermediate transfer body which is disposed at downstream side in the conveying direction of the toner image.

In this way, it is possible to transfer a toner image which does not have color offset to the transfer medium by the image carriers and the intermediate transfer bodies which can be joined together and separated from one another as separate units and at which phase adjustment is difficult.

An image forming device of another aspect of the present invention has the feature of further including: an image carrier rotating shaft projecting in an axial direction from both axial direction end portions of the image carrier, and suspended at the suspension portion; an intermediate transfer body rotating shaft projecting in an axial direction from both axial direction end portions of the intermediate transfer body; positioning holes formed in the device main body, and when the image carrier and the intermediate transfer body are pushed into the device main body, the positioning holes respectively fit one axial direction end portion of the image carrier rotating shaft and one axial direction end portion of the intermediate transfer body rotating shaft; a pushing/fixing portion fixing another axial direction end portion of the image carrier rotating shaft by pushing the other axial direction end portion of the image carrier rotating shaft to abut the suspension portion; and a positioning/fixing portion positioning and fixing another axial direction end portion side, in the intermediate transfer body rotating shaft direction, of an intermediate transfer body unit, which is structured by the supporting frame at which the intermediate transfer body is mounted, at the device main body.

In the image forming device of this aspect, due to the image carrier rotating shaft, which projects from the both axial direction end portions of the image carrier, being suspended at the suspension portion, the image carrier unit is suspended at the intermediate transfer body unit. Further, the intermediate transfer body rotating shaft projects out in the axial direction from both axial direction end portions of the intermediate transfer body. Positioning holes, which fit one axial direction end portion of the image carrier rotating shaft and one axial direction end portion of the intermediate transfer body rotating shaft respectively when the image carrier unit and the intermediate transfer body unit are pushed into the device main body, are provided at the device main body. The one axial direction end portion of the image carrier rotating shaft and the one axial direction end portions of the intermediate transfer body rotating shaft are thereby positioned.

In this state, the other axial direction end portion of the image carrier rotating shaft is merely suspended at the suspension portion, but is not positioned and in not fixed. Here, the other axial direction end portion of the image carrier rotating shaft is pushed to abut the suspension portion and is fixed thereat by the pushing/fixing portion.

The other axial direction end portion side of the intermediate transfer body rotating shaft of the intermediate transfer body unit is not positioned and in not fixed by the installing portion. Here, the other axial direction end portion side of the intermediate transfer body rotating shaft of the intermediate transfer body unit is positioned and fixed at the device main body by the positioning/fixing portion.

In this way, even if the intermediate transfer body unit and the image carrier unit are formed as structures which can be separated from one another, the both axial direction end portions of the image carrier and the both axial direction end portions of the intermediate transfer body are positioned, and therefore, image quality does not deteriorate.

An image forming device of another aspect of the present invention has the feature that at the intermediate transfer body unit, a first intermediate transfer body and a second intermediate transfer body are disposed as the upstream intermediate transfer bodies, and a third intermediate transfer body is disposed as the downstream intermediate transfer body.

An image forming device of another aspect of the present invention has the feature that the image carrier unit has four image carriers at which are formed single-color toner images of yellow, magenta, cyan, and black, respectively, and the first intermediate transfer body conveys toner images from two image carriers among the four image carriers and the second intermediate transfer body conveys toner images from the other two image carriers.

An image forming device of another aspect of the present invention has the feature that the image carrier rotating shafts project in the axial directions from both axial direction end portions of the image carriers, and at least one image carrier rotating shaft is suspended at the suspension portion, the intermediate transfer body rotating shafts project in the axial direction from both axial direction end portions of the intermediate transfer bodies, and each one axial direction end portion of the intermediate transfer body rotating shafts projects in the axial direction from the supporting frame of the intermediate transfer body unit, intermediate transfer body rotating shaft positioning holes and image carrier rotating shaft positioning holes as the positioning holes are provided in the device main body, and when the image carriers and the intermediate transfer bodies are pushed into the device main body, the intermediate transfer body rotating shaft positioning holes and the image carrier rotating shaft positioning holes respectively fit the one axial direction end portions of the intermediate transfer body rotating shafts and the one axial direction end portions of the image carrier rotating shafts.

An image forming device of another aspect of the present invention has the feature that both axial direction end portions of at least one of the image carrier rotating shafts are suspended at the suspension portion, and one axial direction end portion of at least one of the image carrier rotating shafts is suspended at the suspension portion.

An image forming device of another aspect of the present invention has the feature that the suspension portion is structured by a hook portion which is provided at an end portion, in the axial direction of the intermediate transfer body rotating shaft, of the supporting frame and at which a groove portion in which the image carrier rotating shaft is inserted is formed.

An image forming device of another aspect of the present invention has the feature that the suspension portion is structured by a pair of the hook portions, provided at both end portions, in the axial direction of the intermediate transfer body rotating shaft, of the supporting frame.

What is claimed is:

1. An image forming device having image carriers on which a toner image is formed, and intermediate transfer bodies conveying the toner image, which is formed on the image carriers, to a transfer medium, the image forming device comprising:

an intermediate transfer body unit structured by a first supporting frame in which the intermediate transfer bodies are mounted;

an image carrier unit structured by a second supporting frame in which the image carriers are mounted;

a suspension portion formed on the first supporting frame, the suspension portion attachably/detachably suspending the image carriers at the first supporting frame to mount the image carrier unit on the intermediate transfer body unit; and an attaching/removing portion at which the intermediate transfer body unit is installed, and which is for attaching and removing the intermediate transfer body unit to and from a device main body of the image forming device.

2. The image forming device of claim 1, wherein the image carrier unit further comprises:

charging portions which are disposed at upstream sides, in rotating directions of the image carriers, of scanning regions of the image carriers, and which charge the image carriers; and recovering/holding portions which are disposed at upstream sides, in the rotating directions of the image carriers, of the charging portions, and which recover toner remaining on the image carriers and temporarily hold the toner.

3. The image forming device of claim 2, wherein the image carrier unit has four image carriers at which are formed single-color toner images of yellow, magenta, cyan, and black, respectively.

4. The image forming device of claim 1, further comprising:

image carrier rotating shafts projecting in an axial direction from both axial direction end portions of the image carriers, and suspended at the suspension portion;

intermediate transfer body rotating shafts projecting in an axial direction from both axial direction end portions of the intermediate transfer bodies;

positioning holes formed in the device main body, and when the image carriers and the intermediate transfer bodies are pushed into the device main body, the positioning holes respectively fit one axial direction end portion of the image carrier rotating shafts and one axial direction end portion of the intermediate transfer body rotating shafts;

a pushing/fixing portion fixing another axial direction end portion of the image carrier rotating shafts by pushing the other axial direction end portion of the image carrier rotating shafts to abut the suspension portion; and a positioning/fixing portion positioning and fixing another axial direction end portion side, in the intermediate transfer body rotating shafts direction, of an intermediate transfer body unit, which is structured by the first supporting frame at which the intermediate transfer bodies are mounted, at the device main body.

5. The image forming device of claim 4, wherein the suspension portion is structured by a plurality of hook portions which are provided at an end portion, in the axial direction of the intermediate transfer body rotating shafts, of the first supporting frame and at which a groove portion in which the image carrier rotating shafts are inserted is formed.

6. The image forming device of claim 5, wherein the suspension portion is structured by a plurality of pairs of the hook portions, provided at both end portions, in the axial direction of the intermediate transfer bodies rotating shafts, of the first supporting frame.

7. An image forming device having image carriers on which a toner image is formed, and intermediate transfer bodies conveying the toner image, which is formed on the image carriers, to a transfer medium, the image forming device comprising:

an intermediate transfer body unit structured by a first supporting frame in which the intermediate transfer bodies are mounted;

an image carrier unit structured by a second supporting frame in which the image carriers are mounted;

a suspension portion formed on the first supporting frame, the suspension portion attachably/detachably suspending the image carriers at the first supporting frame to mount the image carrier unit on the intermediate transfer body unit; and an attaching/removing portion at which the intermediate transfer body unit is installed, and which is for attaching and removing the intermediate transfer body unit to and from a device main body of the image forming device, wherein the suspension portion is structured by groove portions which are formed at end portions, in an axial direction of the intermediate transfer bodies, of the first supporting frame, and at which axial direction end portions of a rotating shaft of at least one of the image carriers are respectively inserted.

8. The image forming device of claim 7, wherein the intermediate transfer body unit further comprises:

removing portions removing toner remaining on the intermediate transfer bodies; and conveying portions conveying the toner, which has been removed from the intermediate transfer bodies by the removing portions, to an exterior of the intermediate transfer body unit.

9. The image forming device of claim 7, wherein the image carrier unit has image carrier gears disposed at axial direction one end portions of the image carriers, and the intermediate transfer body unit has intermediate transfer body gears disposed at axial direction one end portions of the intermediate transfer bodies which contact the image carriers having the image carrier gears at the axial direction one end portions thereof, the intermediate transfer body gears meshing with the image carrier gears and transmitting driving force to the image carriers.

10. The image forming device of claim 9, wherein a relationship between a diameter D1 of the image carriers and a diameter D2 of the intermediate transfer bodies is D1=D2× 1/n, where n is a natural number of 2 or more, and at the intermediate transfer body unit, mounted positions, in a rotating direction, of the intermediate transfer body gears and the intermediate transfer bodies are adjusted such that phases, in the rotating direction, are substantially the same at all of the intermediate transfer bodies at a time when the toner image is transferred from an upstream intermediate transfer body which is disposed at upstream side in conveying direction of the toner image, to a downstream intermediate transfer body which is disposed at downstream side in the conveying direction of the toner image.

11. The image forming device of claim 10, wherein, at the intermediate transfer body unit, a first intermediate transfer body and a second intermediate transfer body are disposed as upstream intermediate transfer bodies, and a third intermediate transfer body is disposed as the downstream intermediate transfer body.

12. The image forming device of claim 11, wherein the image carrier unit has four image carriers at which are formed single-color toner images of yellow, magenta, cyan, and black, respectively, and the first intermediate transfer body conveys toner images from two image carriers among the four image carriers and the second intermediate transfer body conveys toner images from the other two image carriers.

13. The image forming device of claim 7 further comprising:

charging portions which are disposed at upstream sides, in rotating directions of the image carriers, of scanning regions of the image carriers, and which charge the image carriers; and recovering/holding portions which are disposed at upstream sides, in the rotating directions of the image carriers, of the charging portions, and which recover toner remaining on the image carriers and temporarily hold the toner.

14. The image forming device of claim 13, wherein the plurality of image carriers are formed of single-color toner images of yellow, magenta, cyan, and black, respectively.

15. The image forming device of claim 7, further comprising:

image carrier rotating shafts projecting in an axial direction from both axial direction end portions of the image carriers, and suspended at the suspension portion;

intermediate transfer body rotating shafts projecting in an axial direction from both axial direction end portions of the intermediate transfer bodies;

positioning holes formed in the device main body, and when the image carriers and the intermediate transfer bodies are pushed into the device main body, the positioning holes respectively fit one axial direction end portion of the image carrier rotating shafts and one axial direction end portion of the intermediate transfer body rotating shafts;

a pushing/fixing portion fixing another axial direction end portion of the image carrier rotating shafts by pushing the other axial direction end portion of the image carrier rotating shafts to abut the suspension portion; and a positioning/fixing portion positioning and fixing another axial direction end portion side, in the intermediate transfer body rotating shafts direction, of an intermediate transfer body unit, which is structured by the first supporting frame at which the intermediate transfer bodies are mounted, at the device main body.

16. The image forming device of claim 15, wherein the image carrier rotating shafts project in the axial directions from both axial direction end portions of the image carriers, and at least one image carrier rotating shaft is suspended at the suspension portion, the intermediate transfer body rotating shafts project in the axial direction from both axial direction end portions of the intermediate transfer bodies, and each one axial direction end portion of the intermediate transfer body rotating shafts projects in the axial direction from the first supporting frame, intermediate transfer body rotating shaft positioning holes and image carrier rotating shaft positioning holes as the positioning holes are provided in the device main body, and when the image carriers and the intermediate transfer bodies are pushed into the device main body, the intermediate transfer body rotating shaft positioning holes and the image carrier rotating shaft positioning holes respectively fit the one axial direction end portions of the intermediate transfer body rotating shafts and the one axial direction end portions of the image carrier rotating shafts.

17. The image forming device of claim 16, wherein both axial direction end portions of at least one of the image carrier rotating shafts are suspended at the suspension portion, and one axial direction end portion of at least one of the image carrier rotating shafts is suspended at the suspension portion.

18. The image forming device of claim 15, wherein the suspension portion is structured by a plurality of hook portions which are provided at an end portion, in the axial direction of the intermediate transfer body rotating shafts, of the first supporting frame and at which a groove portion in which the image carrier rotating shafts are inserted is formed.

19. The image forming device of claim 18, wherein the suspension portion is structured by a plurality of pairs of the hook portions, provided at both end portions, in the axial direction of the intermediate transfer bodies rotating shafts, of the first supporting frame.

* * * * *